US012674243B2

(12) United States Patent
Wijenberg et al.

(10) Patent No.: US 12,674,243 B2
(45) Date of Patent: Jul. 7, 2026

(54) METHOD FOR MANUFACTURING CHROMIUM OXIDE COATED TINPLATE

(71) Applicant: TATA STEEL IJMUIDEN B.V., Velsen-Noord (NL)

(72) Inventors: Jacques Hubert Olga Joseph Wijenberg, Amsterdam (NL); Michiel Steegh, Driehuis (NL); Mark Willem Litz, Aerdenhout (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 283 days.

(21) Appl. No.: 17/433,162

(22) PCT Filed: Feb. 25, 2020

(86) PCT No.: PCT/EP2020/054931
§ 371 (c)(1),
(2) Date: Aug. 23, 2021

(87) PCT Pub. No.: WO2020/173953
PCT Pub. Date: Sep. 3, 2020

(65) Prior Publication Data

US 2022/0136121 A1 May 5, 2022

(30) Foreign Application Priority Data

Feb. 25, 2019 (EP) ..... 19159095

(51) Int. Cl.

| | |
|---|---|
| ***C25D 3/06*** | (2006.01) |
| ***C25D 9/08*** | (2006.01) |
| ***C25D 9/10*** | (2006.01) |
| ***C25D 17/10*** | (2006.01) |
| ***C25D 21/12*** | (2006.01) |

(52) U.S. Cl.
CPC ..... *C25D 3/06* (2013.01); *C25D 17/10* (2013.01); *C25D 21/12* (2013.01)

(58) Field of Classification Search
CPC .... C25D 3/06; C25D 9/10; C25D 9/08; C23C 18/1653
USPC ..... 205/319, 320, 199
See application file for complete search history.

(56) References Cited

U.S. PATENT DOCUMENTS 4,169,022 A * 9/1979 Ward ..... C25D 3/06 205/319
6,004,448 A 12/1999 Martyak
6,099,714 A * 8/2000 Bibber ..... C25D 11/38 205/243

FOREIGN PATENT DOCUMENTS

| | | | | |
|---|---|---|---|---|
| CN | 101280440 A * | 10/2008 | ..... | C25D 3/06 |
| CN | 105274583 A * | 1/2016 | ..... | C25D 3/06 |
| EP | 3378973 A1 * | 9/2018 | ..... | C25D 9/10 |
| EP | 3428321 A1 * | 1/2019 | ..... | C25D 3/06 |
| WO | 2012045791 A1 | 4/2012 | | |

(Continued)

OTHER PUBLICATIONS

Van Parys et al., "Characterization of Cathodic Film Formed During Reduction of Chromic Acid: Role of Sulphuric Acid Concentration," Surface and Interface Analysis (2004), vol. 36, No. 13, pp. 1609-1619. (Year: 2004).*

(Continued)

*Primary Examiner* — Edna Wong
(74) *Attorney, Agent, or Firm* — Vorys, Sater, Seymour and Pease LLP; Maryellen Feehery Hank

(57) ABSTRACT

A method for electroplating a steel strip with a plating layer and an improvement thereof.

22 Claims, 3 Drawing Sheets

(56) References Cited

FOREIGN PATENT DOCUMENTS

| | | | | |
|---|---|---|---|---|
| WO | WO-2014202316 A1 * | 12/2014 | ..... | C09D 5/08 |
| WO | WO-2015177315 A1 * | 11/2015 | ..... | C25D 9/08 |
| WO | WO-2018087135 A1 * | 5/2018 | ..... | C25D 17/00 |

OTHER PUBLICATIONS

Pollnow, "Tinplate, and Electrolytic Tinning at the Iscor Works, Vanderbijlpark," Journal of the Southern African Institute of Mining and Metallurgy (Jan. 1, 1977), vol. 77, No. 6, pp. 126-131. (Year: 1977).*

Kawaguchi et al., "Control of Amorphization of IrO2—Ta2O5/Ti Electrodes to Suppress Unwanted Side Reaction," ECS Meeting Abstracts (Aug. 29, 2008), No. 42, p. 2658. (Year: 2008).*

International Search Report and Written Opinion mailed May 26, 2020 for PCT/EP2020/054931 to Tata Steel Ijmuiden B.V. filed Feb. 25, 2020.

Heidi Van Parys, et al., "Characterization of cathodic film formed during reduction of chromic acid: role of sulphuric acid concentration", Surface and Interface Analysis, Surf. Interface Anal. 2004; 36: 1609-1619 Published online Nov. 29, 2004 in Wiley InterScience (www.interscience.wiley.com). DOI: 10.1002/sia.1995.

James P. Hoare, "On the Mechanisms of Chromium Electrodeposition", J. Electrochem. Soc. Electrochemical Science and Technology, Feb. 1979, vol. 126, No. 2, pp. 190-199.

* cited by examiner

METHOD FOR MANUFACTURING CHROMIUM OXIDE COATED TINPLATE

CROSS-REFERENCE TO RELATED APPLICATIONS

This is a § 371 National Stage Application of International Application No. PCT/EP2020/054931 filed on Feb. 25, 2020, claiming the priority of European Patent Application No. 19159095.9 filed on Feb. 25, 2019.

FIELD OF THE INVENTION

This invention relates to a method for electroplating tinplate with a protective layer, and to tinplate produced thereby.

BACKGROUND OF THE INVENTION

Tin mill products traditionally include electrolytic tinplate, electrolytic chromium coated steel (also referred to as tin free steel or TFS), and blackplate. Although not limited by it, most applications for tin mill products are used by the container industry in the manufacturing of cans, ends and closures for the food and beverage industry.

In continuous steel strip plating, a cold-rolled steel strip is provided which is usually annealed after cold-rolling to soften the steel by recrystallisation annealing or recovery annealing. After the annealing and before plating the steel strip is first cleaned for removing oil and other surface contaminants. After the cleaning step, the steel strip is pickled in a sulphuric or hydrochloric acid solution for removing the oxide film. Between different treatment steps the steel strip is rinsed to prevent contamination of the solution used for the next treatment step. During rinsing and transport of the steel strip to the plating section a fresh thin oxide layer is formed instantly on the bare steel surface. The bare steel surface needs to be protected against further oxidation by depositing a coating layer onto the steel.

One such protection is provided by a process used in electroplating called electrodeposition. The part to be plated (the steel strip) is the cathode of the circuit. The anode of the circuit may be made of the metal to be plated on the part (dissolving anode, such as those used in conventional tinplating) or a dimensionally stable anode (which does not dissolve during plating). The anode and cathode are immersed in an electrolyte solution containing ions of the metal to be deposited onto the blackplate substrate.

Blackplate is a tin mill product which has not (yet) received any metallic coating during production. It is the basic material to produce other tin mill products. Blackplate may be single reduced or double reduced. For a single reduced blackplate a hot-rolled strip is reduced to the desired thickness in a cold rolling mill and subsequently recrystallisation or recovery annealed in a continuous or batch annealing process, and optionally temper rolled. For a double reduced blackplate the single rolled substrate is subjected to a second rolling reduction of more than 5%. A temper rolled single reduced blackplate is generally not seen as a double reduced blackplate because the temper rolling reduction is below 5%.

The SR or DR blackplate is usually provided in the form of a coiled strip.

Tinplate consists of blackplate coated with one or more thin layer of tin. The tin is usually applied by electrodeposition, and usually on both sides of the blackplate. The tin layer may be flow melted, e.g. by induction or resistance heating, to enhance the corrosion resistance of the product by formation of an inert $FeSn_2$-alloy layer. Tinplate may be provided with the same thickness of tin on both sides, or with different thickness (differential coating). Flow melted tin plate has a thin tin oxide film on the surface which, if untreated, can grow during storage. To improve the tarnish resistance and laquerability an electrochemical passivation (passivation code 311) is applied to the flow melted tin plate immediately after plating (known as 311 passivation). Non-reflowed and reflowed tinplate can be treated by a chemical passivation (passivation code 300). These passivation treatments involve treatment in dichromate solutions. This treatment deposits a complex layer of chromium and its hydrated oxides, which inhibits the growth of tin oxides, preventing yellowing, improving paint adhesion and minimising staining by sulphur compounds. Dichromate or chromic acid solutions contain Cr(VI) compounds. REACH, the European Union regulation on chemicals, bans the use of these hexavalent chromium compounds. Consequently, over time alternatives have been developed based on harmless compounds.

A specific type of tinplate is provided with an FeSn (50 at. % iron and 50 at. % tin) alloy layer. This is produced by diffusion annealing tinplate containing at most 1000 mg/m2 and preferably between at least 100 and/or at most 600 mg/m2 of deposited tin at a temperature of at least 513° C. in a reducing atmosphere, at which temperature the tin layer is converted into an iron-tin alloy that consists of FeSn. The FeSn layer may be coated with a further tin layer which would conventionally require a passivation treatment like normal tinplate.

OBJECTIVES OF THE INVENTION

It is an object of the invention to provide a REACH compliant alternative for the Cr(VI) based passivation treatment that prevents growth of the tin oxide film on tinplate.

It is also an object of the invention to provide a REACH compliant alternative for the Cr(VI) based passivation treatment that improves lacquer adhesion to tinplate.

DESCRIPTION OF THE INVENTION

One or more of the objects is reached with a method for electrolytically depositing a chromium oxide layer onto a tinplate substrate in a continuous high speed plating line operating at a line speed of at least 50 m/min from a halide-ion free aqueous electrolyte solution comprising a trivalent chromium compound provided by a water soluble chromium(III) salt, wherein the steel substrate acts as a cathode and wherein an anode comprises a catalytic coating of i). iridium oxide or ii). a mixed metal oxide comprising iridium oxide and tantalum oxide, for reducing or eliminating the oxidation of $Cr^{3+}$-ions to $Cr^{6+}$-ions, and wherein the electrolyte solution contains at least 50 mM and at most 1000 mM Cr3+-ions, a total of from 25 to 2800 mM of sodium sulphate or potassium sulphate, a pH of between 2.50 and 3.6 measured at 25° C., and wherein the plating temperature is between 40 and 70° C. and wherein no other compounds are added to the electrolyte, except optionally sulphuric acid or sodium or potassium hydroxide to adjust the pH to the desired value.

For the sake of clarity, it is noted that 1 mM means 1 millimole/l. It should also be noted that there are two potential sources of sodium sulphate in the electrolyte. Firstly, if basic chromium sulphate is used as the water-soluble chromium (III) salt, of which the chemical formula is $(CrOHSO_4)_2 \times Na_2SO_4$, then for each mM of Cr 0.5 mM of $Na_2SO_4$ is added as well to the electrolyte. However, $Na_2SO_4$ can also be added as a salt separately, e.g. as a conductivity enhancing salt or to increase the kinematic viscosity of the electrolyte. The total amount of $Na_2SO_4$ is the sum of the addition of the $Na_2SO_4$ and the amount that comes along with the basic chromium (III) sulphate. If no basic chromium sulphate is used as the water-soluble chromium (III), but for instance chromium(III) sulphate or chromium(III) nitrate, then any $Na_2SO_4$ present in the electrolyte was added as sodium sulphate. The above Cr(III) salts, including basic chromium(III) sulphate may be provided alone or in combination.

Steel substrate in the sense of the invention intends to mean the steel basis including the tin-based metallic layers that have been deposited thereupon prior to depositing the chromium oxide layer according to the invention.

The absence of a complexing agent in the electrolyte means that an essential component for depositing Cr-metal is absent. The complexing agent is required for destabilising the very stable $[Cr(H_2O)_6]^{3+}$ complex. The inventors surprisingly found that by avoiding the use of a complexing agent (e.g. NaCOOH) the deposition of chromium metal is prevented but instead a closed layer of chromium oxide is deposited. With a closed oxide layer an oxide layer is meant that covers the entire surface of the substrate and that adheres to the surface well. Moreover, the absence of the carbon-containing complexing agent also prevented the co-deposition of chromium carbide in the oxide layer. Any residual amounts of chromium carbide, if present in detectable amounts in the oxide layer, are therefore the result of minute and inevitable amounts of residual other compounds present in the base material to produce the electrolyte. The presence of sulphate in the electrolyte causes the presence of sulphate in the chromium oxide coating layer under the plating conditions according to the invention. The maximum amount of sulphate detected at the surface is about 10%. The minimum amount of sulphate at the surface is 0.5%, and in most cases at least 2%. These values were derived from XPS depth profiles over the first 3 nm starting at the outer surface.

Because of the closed layer of chromium oxide onto the substrate the adhesion between the substrate upon which the closed layer of chromium oxide is deposited and an organic coating layer is much improved.

If the pH of the electrolyte solution becomes too high or too low, then sulphuric acid or sodium hydroxide may be added to adjust the pH to a value inside the desired range. Also, different acids or bases may be used, but in view of the simplicity of the bath chemistry sulphuric acid and sodium hydroxide are preferable.

Sodium sulphate or potassium sulphate also acts as a conductivity enhancing salt. To keep the electrolyte as simple as possible, and to prevent the formation chlorine or bromine, the conductivity enhancing salt is a sulphate-salt. The cation is preferably sodium or potassium. For the electrolyte not to become too viscous, a maximum amount of 2800 mM of sodium—or potassium sulphate is still allowable. For reasons of simplicity the cation is preferably sodium. A pH over 4 results in a colloidal reaction in the electrolyte rendering it unusable for electroplating. A pH below 2.50 is undesirable because the increase of surface pH at the cathode needed to deposit the chromium-oxide (CrOx) cannot be obtained at these low pH values in the electrolyte. The high pH also enable the use of lower current densities during deposition, resulting in less hydrogen evolution. Excessive hydrogen evolution is believed to be causing the stripy appearance of the surface at lower pH (below 2.50). The relatively high electrolyte temperature electrolyte of at least 40° C. also allows using a lower current density, thereby also helping to reduce hydrogen evolution.

Preferably only sodium sulphate is used in the electrolyte, because it keeps the electrolyte's composition as simple as possible.

Halide ions, such as chloride ions or bromide ions, may not be present in the electrolyte. This absence is needed to prevent formation of (e.g.) chlorine or bromine at the anode. The electrolyte also does not contain a depolarizer. In many similar baths, potassium bromide is used as depolarizer. The absence of this compound mitigates any risk of bromine formation at the anode. Also, a buffering agent, such as the often-used boric acid ($H_3BO_3$), is not present in the electrolyte.

It is essential in the method according to the invention that the anode comprises i). a catalytic coating of iridium oxide or ii). a mixed metal oxide comprising iridium oxide and tantalum oxide. The catalytic coating is generally deposited onto a titanium anode, wherein the coverage of the titanium is such that titanium is not exposed to the electrolyte. The use of any other practical anode, such as platinum, platinised titanium or nickel-chromium, was found to result in the formation of $Cr^{6+}$-ions which is to be avoided because of the toxic and carcinogenic nature of Cr(VI) compounds. Carbon as anode material disintegrates over time because of the high current densities used in the industrial high-speed plating lines and should also not be used.

In the method according to the invention the steel substrate is blackplate coated with tin (tinplate) or blackplate coated with an FeSn-alloy layer (See FIG. 3). WO2012045791 discloses a method to produce blackplate coated with an FeSn-alloy layer.

The steel used for blackplate can be any steel grade suitable for producing packaging steel. By means of example, but not intended to be limited by this, reference is made to the steel grades for packaging applications in EN10202:2001 and ASTM 623-08:2008.

The blackplate is usually provided in the form of a strip of low carbon (LC), extra low carbon (ELC) or ultra-low carbon (ULC) with a carbon content, expressed as weight percent, of between 0.05 and 0.15 (LC), between 0.02 and 0.05 (ELC) or below 0.02 (ULC) respectively. Alloying elements like manganese, aluminium, nitrogen, but sometimes also elements like boron, are added to improve the mechanical properties (see EN10202, 10205 and 10239). The blackplate may consist of an interstitial-free low, extra-low or ultra-low carbon steel, such as a titanium stabilised, niobium stabilised or titanium-niobium stabilised interstitial-free steel.

Single reduced (SR) blackplate, as defined in international standards, falls within the range 0.15 mm to 0.49 mm; double reduced (DR) blackplate from 0.13 mm to 0.29 mm, the typical range for DR being 0.14-0.24 mm. Lower gauges down to 0.08 mm are now available for special uses, either in single- or double-reduced base materials.

The method according to the invention allows good control of the oxide layer, allows to deposit a closed oxide layer, i.e. an oxide layer covering the entire surface of the substrate, and allows to improve the performance of the oxide layer in terms of improving the adhesion to organic coatings.

The method according to the invention also allows the deposition of a closed chromium oxide layer on top of a tin layer or a FeSn-layer. The absence of a complexing agent means that no or only a very small amount of metallic chromium is codeposited. This chromium oxide layer serves as a passivation layer and since this chromium oxide layer is deposited by means of Cr(III)-technology, this deposition process is REACH compliant. The chromium oxide layer also improves the adhesion to organic coatings. The laquerability of the tinplate is brought to the same level as the tinplate or the FeSn coated steel treated with the known Cr(VI) based passivation treatments. In case the FeSn-diffusion layer is overcoated with a tin layer, the materials passivation and adhesion behaviour is considered similar to tinplate in the context of this invention.

So, although the substrates may be different, the effect of the closed chromium oxide layer deposited on the substrate, in each case, results in an improvement of the adhesion between the substrate and organic coatings. Also there is the additional benefit of providing a REACH compliant passivation treatment that can replace the current Cr(VI)-based passivation treatments such as the 311 and 300 treatment.

Preferable embodiments are provided in the dependent claims.

As the water soluble chromium (III) salt one or more salts is selected from the group of salts consisting of basic chromium(III) sulphate, chromium(III) sulphate and chromium(III) nitrate. The use of only basic chromium(III) sulphate is preferable from the point of view of keeping the bath chemistry as simple as possible.

In an embodiment the electrolyte solution contains at most 500 mM of $Cr^{3+}$-ions, preferably at most 350 mM, more preferably at most 250 mM or even at most 225 mM of $Cr^{3+}$-ions. The electrolyte solution preferably contains at least 100 mM of $Cr^{3+}$-ions, preferably at least 125 mM of $Cr^{3+}$-ions. These preferred ranges provide good results.

In a preferable embodiment the pH of the electrolyte is between 2.50 and 3.25 measured at 25° C. Preferably the plating temperature is between 35 and 65° C. In an embodiment the pH of the electrolyte solution is at most 3.30, preferably at most 3.00. In an embodiment the pH is at least at least 2.60 or even at least 2.70. The pH range between 2.55 and 3.25 provided excellent results in terms of coating quality. Also, above the value of 3.25 the risk of a colloidal reaction in the electrolyte rendering it unusable for electroplating is non-existent in the method according to the invention. In the pH range between 3.25 and 4 the risk increases from acceptable just over 3.25 to unacceptable if the pH is above 4. Below 2.55 the process becomes less economical because the effort required to increase the surface pH at the cathode is larger at lower pH.

The plating time, i.e. the duration of the application of electrical current to the cathod, which is considerably shorter than the immersion time, is preferably as short as possible to allow use of the method in an industrial line. At low line speeds and/or long anode lengths, the plating time is at most 3 seconds. A maximum plating time of at most 1000 ms is still allowable, preferably at most 900 ms. At very high line speeds the current density and/or the total anode length may need to be increased to keep the line at a practical minimum. Although in the method according to the invention it is preferable that no complexing agent whatsoever is present in the electrolyte, it may nevertheless occur that, despite all due care and use of intermediate rinsing baths, minute amounts are unavoidably present as inevitable impurities in the electrolyte as a result of drag-in from previous upstream electrolyte baths in the plating line. An allowable maximum is 10 mM of complexing agent, such as NaCOOH, preferably at most 5 mM, preferably at most 2 mM. These amounts were found not to result in the deposition of chromium metal of any significance and the quality of the deposited oxide layer adhesion appeared unaffected. Nevertheless it is preferable that no such complexing agent is present in the electrolyte for the method according to the invention.

In an embodiment the electrolyte solution contains at least 210 mM and/or at most 845 mM of sodium sulphate.

In a preferred embodiment the plating temperature is at least 50° C., preferably at least 55° C.

In an embodiment the line speed of the continuous plating line is at least 100 m/min, more preferably at least 200 m/min.

In a preferred embodiment the aqueous electrolyte consists only of basic chromium(III) sulphate, sodium sulphate and optionally sulphuric acid or sodium hydroxide in an amount sufficient to adjust the pH of the electrolyte to the desired value and inavoidable impurities. Preferably the pH is adjusted to a value of 2.55 or more, and preferably to a value of 3.25 or less.

In an embodiment of the invention tinplate, or blackplate provided with an FeSn layer, is provided with the chromium oxide layer applied with the method according to the invention, and is further coated on one or both sides by a lacquering step, film lamination step or a direct extrusion step, with an organic coating consisting of a lacquer, a thermoplastic single layer, or a thermoplastic multi-layer polymer, preferably wherein the thermoplastic polymer coating is a polymer coating system comprising one or more layers comprising thermoplastic resins such as polyesters or polyolefins, acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and or blends thereof.

Preferably the thermoplastic polymer coating is a polymer coating system that comprises one or more layers of thermoplastic resins such as polyesters or polyolefins, but can also include acrylic resins, polyamides, polyvinyl chloride, fluorocarbon resins, polycarbonates, styrene type resins, ABS resins, chlorinated polyethers, ionomers, urethane resins and functionalised polymers. For clarification:

- Polyester is a polymer composed of dicarboxylic acid and glycol. Examples of suitable dicarboxylic acids include therephthalic acid, isophthalic acid (IPA), naphthalene dicarboxylic acid and cyclohexane dicarboxylic acid. Examples of suitable glycols include ethylene glycol, propane diol, butane diol, hexane diol, cyclohexane diol, cyclohexanedimethanol (CHDM), neopentyl glycol etc. More than two kinds of dicarboxylic acid or glycol may be used together.
- Polyolefins include for example polymers or copolymers of ethylene, propylene, 1-butene, 1-pentene, 1-hexene or 1-octene.
- Acrylic resins include for example polymers or copolymers of acrylic acid, methacrylic acid, acrylic acid ester, methacrylic acid ester or acrylamide.
- Polyamide resins include for example so-called Nylon 6, Nylon 66, Nylon 46, Nylon 610 and Nylon 11.
- Polyvinyl chloride includes homopolymers and copolymers, for example with ethylene or vinyl acetate.
- Fluorocarbon resins include for example tetrafluorinated polyethylene, trifluorinated monochlorinated polyethylene, hexafluorinated ethylene-propylene resin, polyvinyl fluoride and polyvinylidene fluoride.
- Functionalised polymers for instance by maleic anhydride grafting, include for example modified polyethylenes, modified polypropylenes, modified ethylene acrylate copolymers and modified ethylene vinyl acetates.

Mixtures of two or more resins can be used. Further, the resin may be mixed with anti-oxidant, heat stabiliser, UV absorbent, plasticiser, pigment, nucleating agent, antistatic agent, release agent, anti-blocking agent, etc. The use of such thermoplastic polymer coating systems has shown to provide excellent performance in can-making and use of the can, such as shelf-life.

Preferably the thermoplastic polymer coating is a polymer coating system comprising one or more layers comprising thermoplastic resins such as polyesters or polyolefins, acrylic resins, polyamides, polyvinyl chloride, fluorocarbon resins, polycarbonates, styrene type resins, ABS resins, chlorinated polyethers, ionomers, urethane resins and functionalised polymers; and/or copolymers thereof; and or blends thereof.

Preferably the thermoplastic polymer coating on the one or both sides of the coated blackplate is a multi-layer coating system, said coating system comprising at least an adhesion layer for adhering to the coated blackplate, a surface layer and a bulk layer between the adhesion layer and the surface layer, wherein the layers of the multi-layer coating system comprise or consist of polyesters, such as polyethylene terephthalate, Isophthalic acid (IPA)—modified polyethylene terephthalate, cyclohexane dimethanol (CHDM)—modified polyethylene terephthalate, polybutylene terephthalate, polyethylene naphthalate, or copolymers or blends thereof.

The application process of the thermoplastic polymer coating is preferably performed by laminating a polymer film onto the coated blackplate by means of extrusion coating and lamination, wherein a polymer resin is melted and formed into thin hot film, which is coated onto the moving substrate. The coated substrate then usually passes between a set of counter-rotating rolls, which press the coating onto the substrate to ensure complete contact and adhesion. The alternative is film lamination, where a film of the polymer is supplied and coated onto a heated substrate and pressed onto the substrate by and between a set of counter-rotating rolls to ensure complete contact and adhesion.

EXAMPLES

As substrates the materials according to table 1 were used.

TABLE 1

Substrates.

| FIG. 2 | material | Cr(ΔXRF) mg $m^{-2}$ |
|---|---|---|
| 1 | Blackplate (uncoated mild steel) | n.a. |
| 3 | Tinplate, flowmelted, unpassivated 2.8 g/$m^2$ Sn | n.a. |

TABLE 2

Cr(III) electrolyte compositions

| component | unit | 1 |
|---|---|---|
| Cr(III) concentration | g $l^{-1}$ | 20 |
| additional sodium sulphate | g $l^{-1}$ | 0 |
| complexing agent | g $l^{-1}$ | 0 |

In FIG. 2 results of RCE experiments are presented. Electrolyte 1 was used (20 g/l basic chromium(III) sulphate (385 mM $Cr^{3+}$). The experiments were performed on a rotating cylinder electrode at 776 rpm at 55° C. and a pH of 2.7 (and some at 3.2). 776 rpm corresponds to 100 m/s line speed in an industrial coating line. For the electrodeposition experiments titanium anodes comprising with a catalytic mixed metal oxide of iridium oxide and tantalum oxide were chosen. The rotational speed of the RCE was kept constant at 776 RPM ($\Omega^{0.7}$=6.0 $s^{0.7}$). The substrates are listed in table 1 and the dimensions of the cylinder were 113.3 mm×ø 73 mm. The plating time was 800 ms. In FIG. 2 the CrOx-coating weight (expressed as Cr metal in mg/$m^2$) is plotted as a function of current density for blackplate (1) and tinplate (3).

The amount of Cr-oxide deposited is plotted on the Y-axis. The amount of Cr-oxide is determined by means of XRF. The XRF-measurement is performed as described in the aforecited paper, which is included herein by reference. On the fresh substrate no Cr or CrOx was initially present. By measuring the sample with XRF a value of total deposited chromium is measured (i.e. metal, oxide, sulphate and (if present) carbide). The difference (Δ(XRF)) is then attributed to Cr-oxides, and that is the value plotted in FIG. 2. For samples 1 and 3 no CrOx was present on the fresh substrate prior to coating the substrate with the method according to the invention.

TABLE 3

Details for RCE experiments plotted in FIG. 2.

| # | symbol | substrate | pre-treatment | Colour oxide layer |
|---|---|---|---|---|
| 1 | ● | BP | degreasing & pickling | greyish |
| | ● | BP | degreasing & pickling | greyish |
| | ● | BP | degreasing & pickling | greyish |
| 3 | ■ | Tinplate | degreasing & de-SnOx | greyish |

De-SnOx means that the tin oxide (SnOx) layer is removed using a well-known sodium carbonate treatment, e.g. by (but not limited to) dipping the substrate in a sodium carbonate solution containing between 1 to 50 g/l of $Na_2CO_3$ at a temperature of between 35 and 65° C., and wherein a cathodic current density of between 0.5 and 2 A/$dm^2$ is applied for a period of between 0.5 and 5 seconds.

The RCE results match very well with the results of coil trials in an industrial size pilot line with similar settings 14 g/l Cr, T=55° C., line speed=150 m/$min^1$, Current density=18.75 A $dm^{-2}$, plating time: 600 ms, denoted as "4" in FIG. 2, even though the Cr(III) concentration was slightly lower. It was also found that the pre-treatment of the strip had little influence on the amount of CrOx that was deposited onto the strip.

Similar experiments performed at pH values below 2.50, such as those disclosed in U.S. Pat. No. 6,099,714 showed an unsatisfactory stripy surface quality when performed in an industrial production line on tinplate. U.S. Pat. No. 6,099,714 discloses experiments based on 3×5 $inch^2$ tinplate samples, i.e. in a laboratory setting and intended for piecemeal plating. Apart from the aesthetically unattractive appearance that may put of customers, the stripes may also result in uneven oxide layer thickness and/or composition which may affect the performance of the coated blackplate as a whole.

Trials were performed with tinplate using electrolyte 1 in table 2. The substrate for depositing the oxide layer according to the method of the invention was an unpassivated, flow-melted tinplate (2.8 g/$m^2$ Sn on both sides). The steel blackplate was, in all cases, a 0.223 mm thick, continuously annealed SR low carbon steel (TH340, 0.045% wt.C, 0.205 wt. % Mn, 0.045% wt. % Al_sol).

The samples have been investigated with XPS to determine the composition which revealed that the deposited layer consisted only of chromium oxide.

TABLE 4

Results of Cr as CrOx on tinplate

| de-SnOx | pH | i A/dm$^2$ | t ms | Cr mg/m$^2$ |
|---|---|---|---|---|
| yes | 2.7 | 20 | 800 | 27.0 |
| yes | 2.7 | 40 | 800 | 35.0 |
| yes | 2.7 | 60 | 800 | 64.1 |
| no | 2.7 | 40 | 800 | 32.9 |
| yes | 2.7 | 0 | — | 0.9 |
| yes | 2.7 | 20 | 400 | 6.3 |
| yes | 2.7 | 20 | 200 | 3.3 |
| yes | 2.7 | 20 | 2 × 400 | 16.8 |
| no | 3.2 | 0 | — | 0 |
| yes | 3.2 | 0 | — | 0.1 |
| yes | 3.2 | 20 | 400 | 38.4 |

The tin oxide layer was removed in most cases, so that the surface is that of a fresh tin surface. The experiments without deposition clearly indicate that no chromium oxide is present in those cases.

The samples have been investigated with XPS to determine the composition which revealed that the deposited layer consisted only of chromium oxide, and that no chromium metal was present. The presence of sulphate in the electrolyte causes the presence of sulphate in the chromium oxide coating layer under the plating conditions according to the invention. The maximum amount of sulphate detected at the surface is about 10%. The minimum amount of sulphate at the surface is about 0.5%, and in most cases at least 2%.

BRIEF DESCRIPTION OF THE DRAWINGS

The invention will now be explained by means of the following, non-limiting figures.

Figure 1:
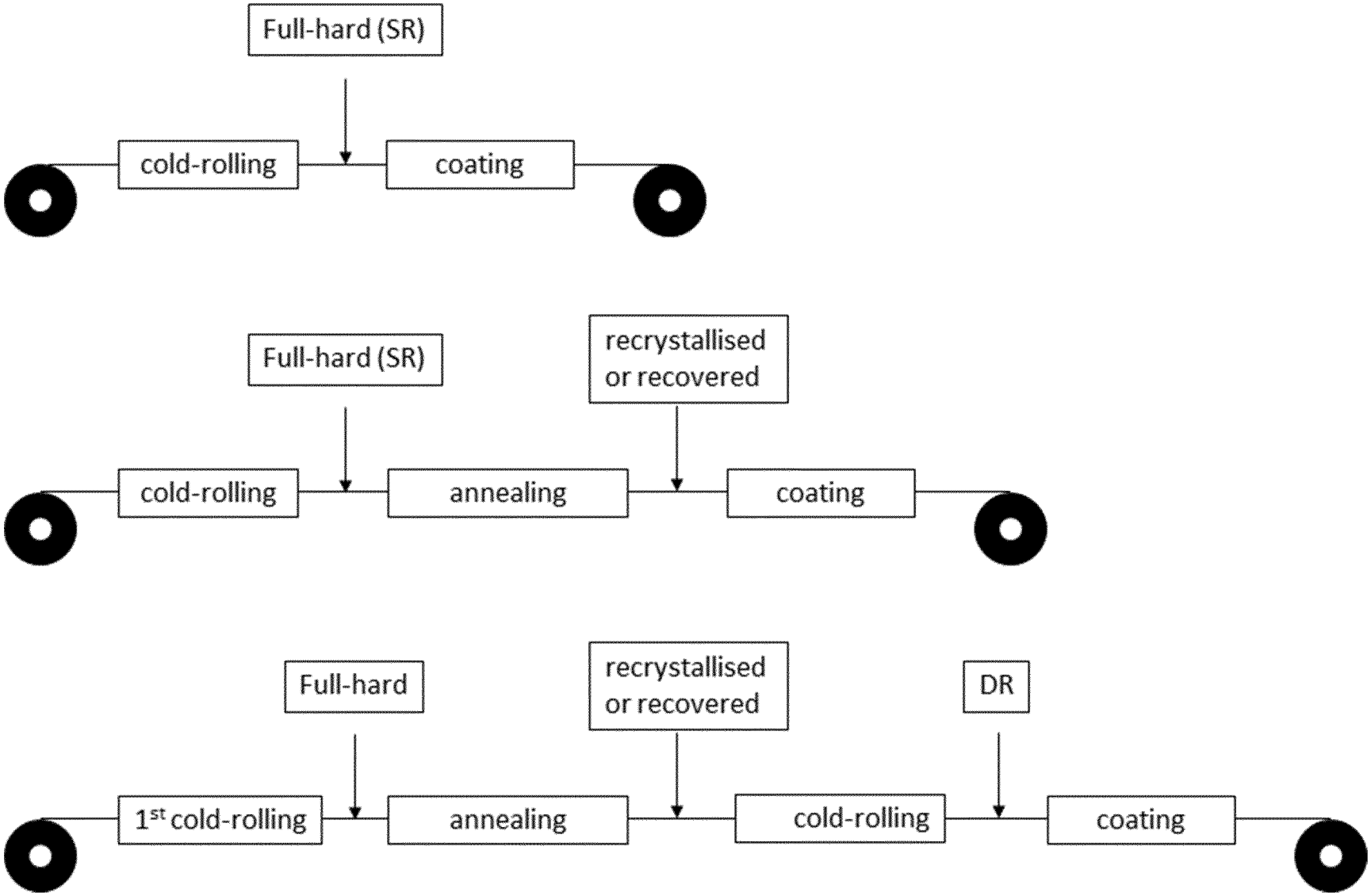
FIG. 1 schematically summarises the process steps to obtain the coated product, starting from a hot-rolled strip. Before cold-rolling, the hot-rolled strip is usually pickled (not shown) to remove the hot-rolling scale and cleaned (not shown) to remove any contaminants from the strip.
Figure 2:
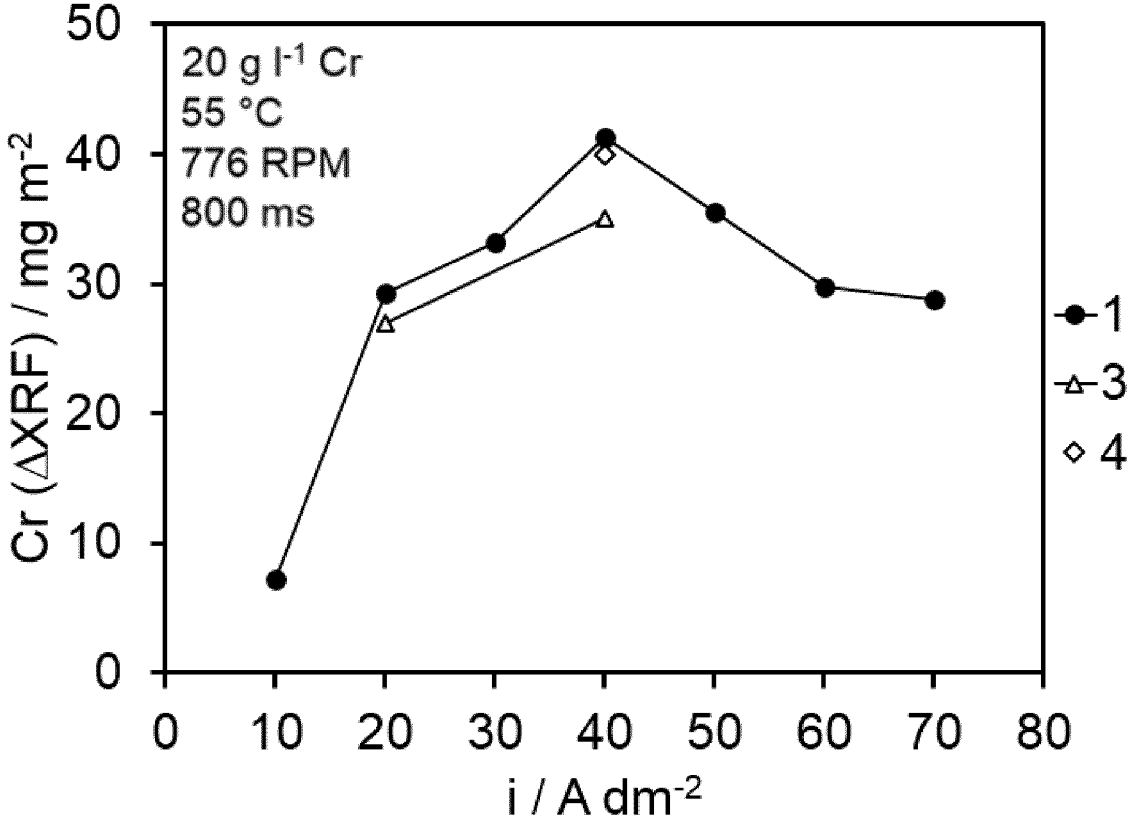
FIG. 2: Amount of Cr-oxide as a function of current density in RCE-experiments for the experiments performed at pH=2.7.
Figure 3:
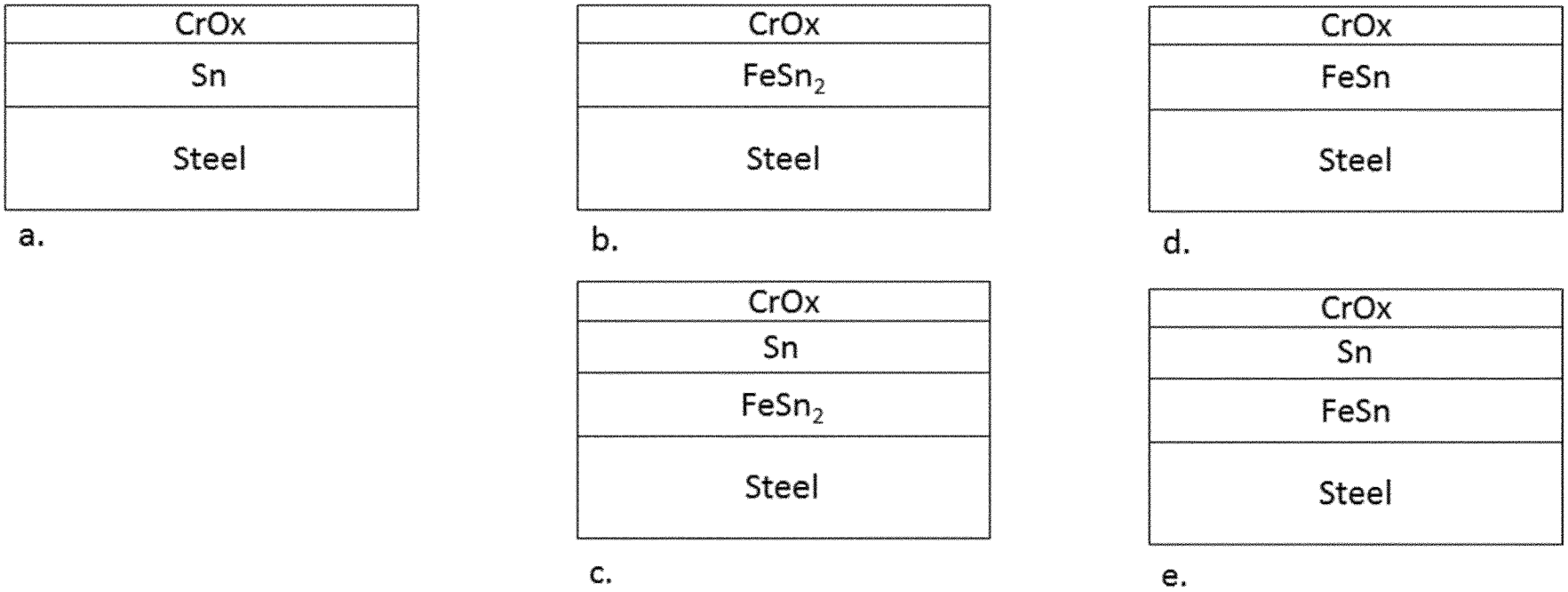
FIG. 3: schematic drawing of tinplate producible with a top layer of CrOx deposited according to the invention.

a. tinplate (not reflown)
b. tinplate (reflown)
c. tinplate (reflown) with additional tin
d. FeSn
e. FeSn with tin

The invention claimed is:

1. A method for electroplating a tinplate strip substrate to manufacture a chromium oxide coated tinplate strip substrate comprising a plating process comprising:

plating by electrolytically depositing a chromium oxide layer having an absence of chromium metal onto the tinplate strip substrate in a continuous high-speed plating line operating at a line speed of at least 50 m/min from a halide-ion free aqueous electrolyte solution wherein there is a trivalent chromium compound in the aqueous electrolyte solution, wherein the trivalent chromium compound is provided by a water-soluble chromium(III) salt selected from at least one member of the group consisting of basic chromium (III) sulphate, chromium (III) sulphate and chromium (III) nitrate, wherein the tinplate strip substrate acts as a cathode, and wherein an anode comprises a catalytic coating of i) iridium oxide or ii) a mixed metal oxide comprising iridium oxide and tantalum oxide, for reducing or eliminating the oxidation of $Cr^{3+}$-ions to $Cr^{6+}$-ions, and wherein the electrolyte solution contains at least 125 mM and at most 1000 mM $Cr^{3+}$-ions from the trivalent chromium compound, a total of from 25 to 2800 mM of a conductivity enhancing salt selected from the group consisting of sodium sulphate and potassium sulphate, and at most 10 mM of a complexing agent, wherein the electrolyte solution has a pH of between 2.50 and 3.6 measured at 25° C., and wherein plating temperature is between 4° and 70° C., and wherein no other compounds are added to the electrolyte solution, except optionally sulphuric acid or sodium hydroxide or potassium hydroxide to adjust the pH to a desired value, wherein the method does not deposit chromium metal, and wherein in the method the only application of an electrical current to the tinplate strip substrate is during the plating by electrolytically depositing step.

2. The method according to claim 1, wherein the pH is in a range of 2.55 to 3.25, wherein the aqueous electrolyte solution consists of:

water, the water-soluble chromium(III) salt, the conductivity enhancing salt selected from the group consisting of sodium sulphate and potassium sulphate, at most 5 mM of the complexing agent, and optionally the sulphuric acid or sodium hydroxide or potassium hydroxide.

3. The method according to claim 1, wherein the electrolyte solution contains at most 5 mM of the complexing agent, and wherein the plating time of the plating, being the duration of application of electrical current to the cathode, is at most 1000 ms.

4. The method according to claim 1, wherein the water-soluble chromium(III) salt is basic chromium(III)sulphate.

5. The method according to claim 1, wherein the chromium oxide layer is deposited in an amount of at least 5 mg/m$^2$.

6. The method according to claim 1, wherein the electrolyte solution contains at most 2 mM of the complexing agent, wherein the complexing agent is sodium formate (NaCOOH).

7. The method according to claim 1, wherein the conductivity enhancing salt is the sodium sulphate, wherein the electrolyte solution consists of:

at least 210 mM of the sodium sulphate, water, the basic chromium(III) sulphate, at most 5 mM of the complexing agent, wherein the complexing agent is sodium formate (NaCOOH), and optionally the sulphuric acid or sodium hydroxide or potassium hydroxide.

8. The method according to claim 1, wherein the plating temperature is between 5° and 70° C., wherein the plating deposits the chromium oxide layer to have an absence of chromium carbide, and wherein the electrolyte solution contains at most 5 mM of the complexing agent.

9. The method according to claim 1, wherein the line speed of the plating line is at least 100 m/min, wherein the electrolyte solution contains no complexing agent.

10. The method according to claim 1, wherein the aqueous electrolyte solution consists of the basic chromium(III) sulphate, the sodium sulphate and optionally the sulphuric acid or sodium hydroxide in an amount sufficient to adjust the pH of the aqueous electrolyte solution to the desired value and unavoidable impurities.

11. The method according to claim 1, wherein the tinplate strip substrate coated with the chromium oxide layer that has an absence of chromium metal is further coated on one or both sides by a lacquering step, a film lamination step or a direct extrusion step with an organic coating consisting of a lacquer, a thermoplastic single layer polymer, or a thermoplastic multi-layer polymer.

12. The method according to claim 1, wherein the tinplate strip substrate coated with the chromium oxide layer that has an absence of chromium metal is further coated on one or both sides by a film lamination step or a direct extrusion step with an organic coating consisting of a thermoplastic polymer coating which is a polymer coating system comprising one or more layers comprising thermoplastic resins selected from at least one member of the group consisting of polyesters, polyolefins, acrylic resins, polyamides, polyvinyl chloride, fluorocarbon resins, polycarbonates, styrene resins, ABS resins, chlorinated polyethers, ionomers, urethane resins, functionalised polymers, copolymers thereof and blends thereof.

13. The method according to claim 1, wherein the tinplate strip substrate coated with the chromium oxide layer that has an absence of chromium metal is further coated on one or both sides by a film lamination step or a direct extrusion step with an organic coating consisting of a thermoplastic polymer coating which is a multi-layer polymer coating system, said multi-layer polymer coating system comprising at least an adhesion layer for adhering to the tinplate strip substrate, a surface layer and a bulk layer between the adhesion layer and the surface layer, wherein the layers of the multi-layer polymer coating system comprise polyesters selected from the group consisting of polyethylene terephthalate, isophthalic acid-modified polyethylene terephthalate, cyclohexanedimethanol-modified polyethylene terephthalate, polybutylene terephthalate, polyethylene naphthalate, copolymers thereof and blends thereof.

14. The method according to claim 1, wherein the pH is adjusted to a value of 2.55 to 3.25.

15. The method according to claim 1, wherein the chromium oxide layer is deposited in an amount of at least 6 $mg/m^2$.

16. The method according to claim 2, wherein the plating deposits the chromium oxide layer to have an absence of chromium carbide.

17. The method according to claim 1, wherein the electrolyte solution contains at most 845 mM of the sodium sulphate.

18. The method according to claim 1, wherein the conductivity enhancing salt is the sodium sulphate, wherein the electrolyte solution contains 210 mM to 845 mM of the sodium sulphate.

19. The method according to claim 1, wherein the tinplate strip substrate coated with the chromium oxide layer that has an absence of chromium metal is further coated on one or both sides by a film lamination step or a direct extrusion step with an organic coating consisting of a thermoplastic polymer coating which is a multi-layer polymer coating system, said multi-layer polymer coating system comprising at least an adhesion layer for adhering to the tinplate strip substrate, a surface layer and a bulk layer between the adhesion layer and the surface layer, wherein the layers of the multi-layer polymer coating system comprise polyesters.

20. The method according to claim 1, wherein said electrolytically depositing the chromium oxide layer onto the tinplate strip substrate deposits a closed layer of chromium oxide, wherein a surface of the chromium oxide layer has 0.5 wt. % to 10 wt. % sulphate.

21. The method according to claim 1, wherein the plating deposits the chromium oxide layer to have an absence of chromium carbide.

22. The method according to claim 1, wherein the plating line passes the tinplate strip substrate into the electrolyte solution for an immersion time to be coated with the chromium oxide layer that has an absence of chromium metal during the immersion time, and then the plating line passes the tinplate strip substrate coated with the chromium oxide layer that has an absence of chromium metal moves out of the electrolyte solution.

* * * * *